US008574007B2

(12) United States Patent
Smith et al.

(10) Patent No.: US 8,574,007 B2
(45) Date of Patent: Nov. 5, 2013

(54) ELECTRICAL CONNECTOR HAVING A SHIELDING ADAPTER TO RADIALLY COMPRESS A SHIELDING FERRULE ONTO A CABLE

(75) Inventors: Alan Stephen Smith, Madison, AL (US); Gary Joseph Elam, Huntsville, AL (US)

(73) Assignee: Curtiss-Wright Flow Control Service Corporation, Falls Church, VA (US)

( * ) Notice: Subject to any disclaimer, the term of this patent is extended or adjusted under 35 U.S.C. 154(b) by 8 days.

(21) Appl. No.: 13/441,121

(22) Filed: Apr. 6, 2012

(65) Prior Publication Data

US 2013/0267119 A1 Oct. 10, 2013

(51) Int. Cl.
*H01R 9/03* (2006.01)

(52) U.S. Cl.
USPC ..... 439/607.5

(58) Field of Classification Search
USPC ..... 439/578–585, 607.01
See application file for complete search history.

(56) References Cited

U.S. PATENT DOCUMENTS

| | | | | |
|---|---|---|---|---|
| 5,104,340 | A | 4/1992 | Elam et al. | |
| 5,997,350 | A * | 12/1999 | Burris et al. | 439/585 |
| 6,089,913 | A * | 7/2000 | Holliday | 439/584 |
| 7,179,122 | B2 * | 2/2007 | Holliday | 439/585 |
| 7,255,598 | B2 * | 8/2007 | Montena et al. | 439/578 |
| 7,931,498 | B2 * | 4/2011 | Skeels et al. | 439/578 |
| 2009/0186505 | A1 * | 7/2009 | Mathews | 439/271 |
| 2010/0261380 | A1 * | 10/2010 | Skeels et al. | 439/584 |

* cited by examiner

*Primary Examiner* — Chandrika Prasad
(74) *Attorney, Agent, or Firm* — Pearne & Gordon LLP

(57) ABSTRACT

An electrical connector assembly is provided having an electromagnetic interference shield. The electrical connector assembly includes a backshell having a backshell bore and a shielding ferrule positioned within the backshell bore to provide an electromagnetic interference shield. The shielding ferrule includes an outer ferrule portion arranged circumferentially around an internal ferrule bore, and a shielding adapter received within the backshell bore of the backshell. The shielding adapter includes a cable extending longitudinally through the shielding adapter and the internal ferrule bore, the shielding adapter engaging the shielding ferrule such that axial movement of the shielding adapter towards the shielding ferrule radially compresses the shielding ferrule onto the cable. The shielding ferrule provides a substantially 360° electromagnetic interference shield around the cable.

19 Claims, 4 Drawing Sheets

ELECTRICAL CONNECTOR HAVING A SHIELDING ADAPTER TO RADIALLY COMPRESS A SHIELDING FERRULE ONTO A CABLE

BACKGROUND OF THE INVENTION

1. Field of the Invention

The invention relates generally to electrical connectors and, more particularly, to an electrical connector having an electromagnetic interference (EMI) shield.

2. Discussion of Prior Art

Electrical connectors are common in the nuclear industry. Generally, electrical connectors can include a male pin assembly having conducting pins and a female socket assembly having conducting sockets. The male pin assembly can be attached to the female socket assembly with the conducting pins being inserted into the conducting sockets. However, electromagnetic interference may be present and can cause disturbances in the electrical connectors. Electrical connectors can be susceptible to the effects of electromagnetic interference due to openings in the male pin assembly and/or female socket assembly. The disturbances can interrupt, obstruct, and/or degrade the electrical signal transferred between the male pin assembly and the female socket assembly. Thus, it would be beneficial to modify an existing electrical connector to provide a 360° electromagnetic interference shield.

BRIEF DESCRIPTION OF THE INVENTION

The following summary presents a simplified summary in order to provide a basic understanding of some aspects of the systems and/or methods discussed herein. This summary is not an extensive overview of the systems and/or methods discussed herein. It is not intended to identify key/critical elements or to delineate the scope of such systems and/or methods. Its sole purpose is to present some concepts in a simplified form as a prelude to the more detailed description that is presented later.

In accordance with one aspect, the present invention provides an electrical connector assembly for providing an electromagnetic interference shield comprising a backshell having a backshell bore extending longitudinally within the backshell, a shielding ferrule positioned within the backshell bore and configured to provide an electromagnetic interference shield, the shielding ferrule including an outer ferrule portion arranged around an internal ferrule bore, and a shielding adapter received within the backshell bore of the backshell, the shielding adapter including a cable extending longitudinally through the shielding adapter and the internal ferrule bore, the shielding adapter engaging the outer ferrule portion of the shielding ferrule such that axial movement of the shielding adapter towards the shielding ferrule is configured to radially compress the shielding ferrule onto the cable, wherein the shielding ferrule is configured to provide a substantially 360° electromagnetic interference shield around the cable.

In accordance with another aspect, the present invention provides an electrical connector assembly for providing an electromagnetic interference shield comprising a backshell having a backshell bore extending longitudinally within the backshell, the backshell including a seat portion extending radially inward towards the backshell bore, a shielding ferrule positioned within the backshell bore and configured to provide an electromagnetic interference shield, the shielding ferrule limited from moving axially with respect to the backshell by the seat portion, and a cable including at least one conductor, the cable extending through an internal ferrule bore of the shielding ferrule and into the backshell bore, wherein the shielding ferrule is configured to radially compress onto the cable such that the shielding ferrule is configured to provide a substantially 360° electromagnetic interference shield around the cable and at least one conductor.

In accordance with another aspect, the present invention provides an electrical connector assembly for providing an electromagnetic interference shield comprising a backshell having a backshell bore extending longitudinally within the backshell, the backshell including a seat portion extending radially inward towards the backshell bore, a shielding ferrule positioned within the backshell bore of the backshell, the shielding ferrule configured to engage the seat portion such that the seat portion limits axial movement of the shielding ferrule with respect to the backshell, the shielding ferrule further including a tapered outer ferrule portion having a decreasing cross-sectional width along a direction extending longitudinally away from the seat portion, and a shielding adapter received within the backshell bore, the shielding adapter including a cable extending longitudinally through the shielding adapter, the shielding adapter engaging the tapered outer ferrule portion of the shielding ferrule, wherein axial movement of the shielding adapter towards the shielding ferrule is configured to radially compress the shielding ferrule onto the cable.

BRIEF DESCRIPTION OF THE DRAWINGS

The foregoing and other aspects of the invention will become apparent to those skilled in the art to which the invention relates upon reading the following description with reference to the accompanying drawings, in which.

DETAILED DESCRIPTION OF THE INVENTION

Figure 1:
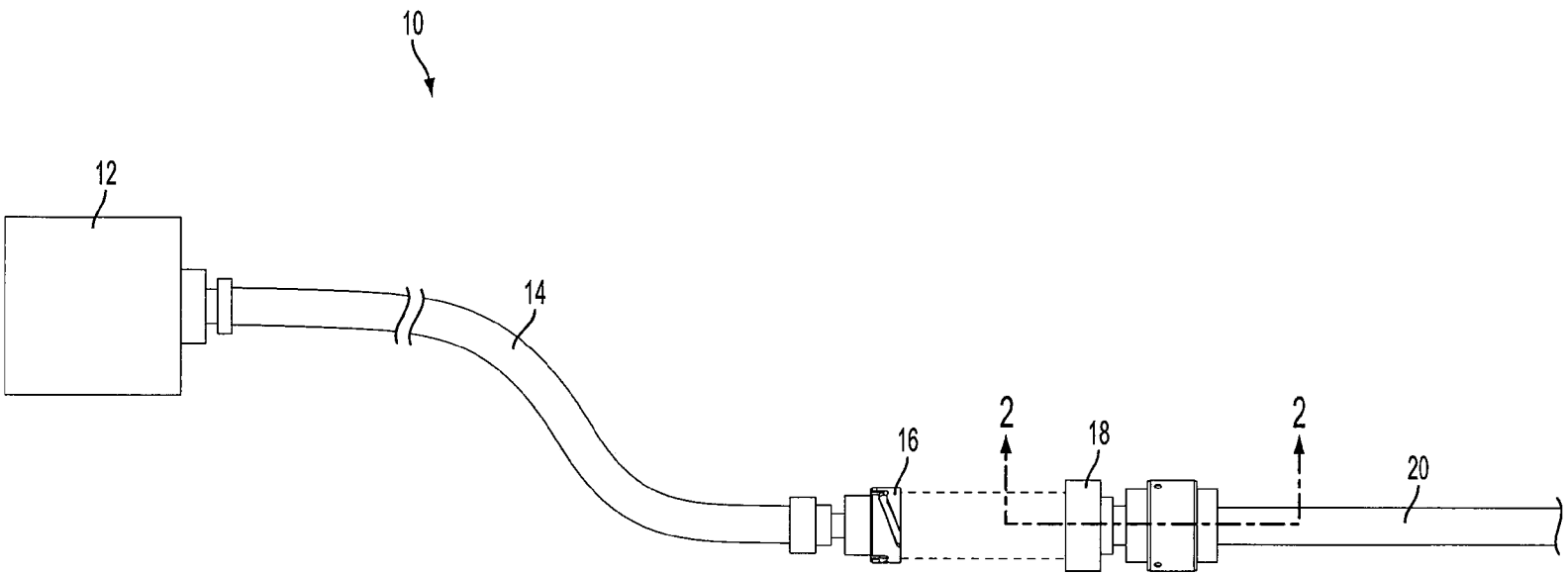
FIG. 1 is a schematic view of an example area and an example electrical connector assembly in accordance with an aspect of the present invention.

Example embodiments that incorporate one or more aspects of the invention are described and illustrated in the drawings. These illustrated examples are not intended to be a limitation on the invention. For example, one or more aspects of the invention can be utilized in other embodiments and even other types of devices. Moreover, certain terminology is used herein for convenience only and is not to be taken as a limitation on the invention. Still further, in the drawings, the same reference numerals are employed for designating the same elements.

FIG. 1 illustrates an example electrical connector assembly 10 according to an aspect of the invention. In short summary, the electrical connector assembly 10 can be used to couple a source of power to an electrical device 12 in an environment that is corrosive and/or includes electromagnetic interference. A pin-side conduit 14 can be attached to the electrical device 12 at one end and to a pin-side electrical connector 16 at an opposing end. The pin-side electrical connector 16 can be attached to a socket-side electrical connector 18. A socket-side conduit 20 can extend from the socket-side electrical connector 18 to an electrical device (not shown), such as a power source, or the like. As will be described in detail below, the socket-side electrical connector 18 can include a 360° electromagnetic interference shield, such that the effects of electromagnetic interference on the electrical connector assembly 10 can be reduced.

The electrical connector assembly 10 can be used in a number of environments, and it is to be appreciated that FIG. 1 is only a generic/schematic depiction of the electrical connector assembly 10. For instance, in one example, the electrical connector assembly 10 can be used in a variety of nuclear environments, such as nuclear power plants, nuclear powered ships, or the like. Other example environments can include, but are not limited to, steel mills, factories, hydro plants, etc. Some or all of these environments may contain electromagnetic interference. It is to be understood, however, that the electrical connector assembly 10 could be used in nearly any environment, including environments having electromagnetic interference (e.g., radio frequency interference), and is not limited to the environments set forth herein.

The electrical connector assembly 10 can include the electrical device 12. The electrical device 12 is only generically/schematically depicted in FIG. 1, as it is understood that the electrical device 12 can include nearly any type of electrical device. For instance, in one example, the electrical device 12 can include a number of different transmitters, such as nuclear pressure transmitters. However, nearly any type of electrical device is contemplated, including nuclear devices, or the like.

The electrical connector assembly 10 can further include a pin-side conduit 14. The pin-side conduit 14 can be attached at one end to the electrical device 12 such that the pin-side conduit 14 is in operative association (i.e., electrically connected) with the electrical device 12. The pin-side conduit 14 is only generically/schematically depicted in FIG. 1, as it is understood that the pin-side conduit 14 can include a number of conduit/connector-like structures. Moreover, the pin-side conduit 14 can be longer or shorter in length than the example shown in FIG. 1. The pin-side conduit 14 can be sized to receive wires, cables, conductors, or the like that run longitudinally through a center of the pin-side conduit 14. As is generally known, the wires, cables, or conductors can be surrounded by a cable jacket, heat shrink tubing, braid shield, or similar outer protective layers that can cover the one or more conductors. As such, the pin-side conduit 14 can simultaneously house and provide protection to the wires, cables, or conductors. Further, the pin-side conduit 14 can transfer electrical signals to and/or from the electrical device 12.

The electrical connector assembly 10 can further include a pin-side electrical connector 16. The pin-side electrical connector 16 can be attached to an end of the pin-side conduit 14 that is opposite from the electrical device 12. As such, the pin-side electrical connector 16 can be in operative association (i.e., electrically connected) with the electrical device 12. The pin-side electrical connector 16 can include a variety of different constructions, some of which may be generally known. For instance, in one example, the pin-side electrical connector 16 can include one or more male pins (not shown), that can extend in a direction away from the pin-side electrical connector 16. The male pins can be attached to conductors located within the pin-side conduit 14 in a number of ways, such as with pin extenders, solder, or the like, such that the male pins and the conductors are electrically connected. Moreover, as is generally known, the pin-side electrical connector 16 can further include a dielectric insulating material, or the like, that can surround the male pins. It is to be understood, however, that the pin-side electrical connector 16 is somewhat generically/schematically shown in FIG. 1, and could include any number of constructions, some of which may be generally known. As such, the pin-side electrical connector 16 shown in FIG. 1 is not intended to be limiting on further examples of the electrical connector assembly 10.

The pin-side electrical connector 16 can be in operative association with the socket-side electrical connector 18. As will be described in more detail below, the socket-side electrical connector 18 can be electrically connected to the pin-side electrical connector 16. The socket-side electrical connector 18 can further be attached to a socket-side conduit 20. The socket-side conduit 20 can be attached at one end to the socket-side electrical connector 18 and at an opposing end to an electrical device, such as a power source, or the like. It is to be understood, however, that the socket-side electrical connector 18 is somewhat generically shown in FIG. 1 for clarity and illustrative purposes, and is more clearly shown in FIGS. 2 and 3. Specifically, the socket-side electrical connector 18 is shown in a detached state from the pin-side electrical connector 16. However, it is to be appreciated that the socket-side electrical connector 18 can be readily attached/detached from the pin-side electrical connector 16.

Figure 2:
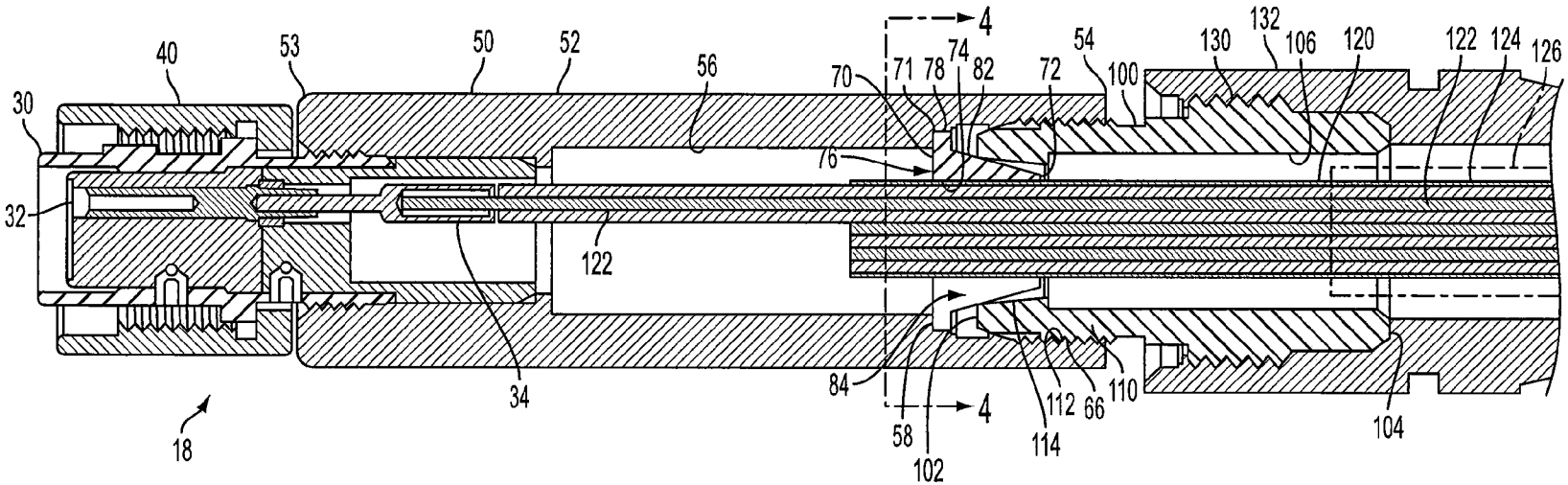
FIG. 2 is a sectional view taken along line 2-2 of FIG. 1 and shows the example electrical connector including a shielding ferrule in an uncompressed state.

Referring now to FIG. 2, the structure of the socket-side electrical connector 18 can now be more fully described. The socket-side electrical connector 18 can include a socket portion 30. The socket portion 30 can be positioned at an end of the socket-side electrical connector 18 and can be attached to the pin-side electrical connector 16. The socket portion 30 can be sized and shaped to mate with the pin-side electrical connector 16.

Figure 3:
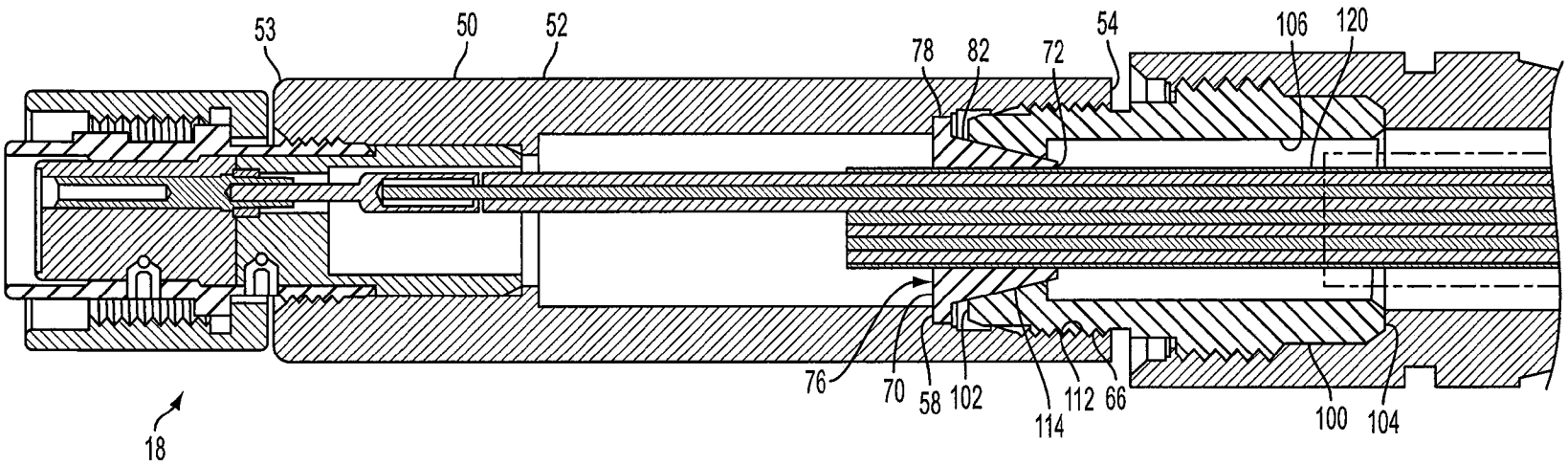
FIG. 3 is a sectional view similar to FIG. 2, but shows the example electrical connector in the shielding ferrule in a compressed state.

The socket portion 30 can include one or more socket openings 32. The socket openings 32 can be sized to receive the male pins from the pin-side electrical connector 16. The socket openings 32 can define a substantially hollow internal bore extending longitudinally through the socket portion 30. For illustrative and clarity purposes, only one socket opening is shown in FIGS. 2 and 3. However, it is to be understood that more than one socket opening can be provided to extend through the socket portion 30. In further examples, the socket openings 32 can be substantially surrounded by an insulating material, which can provide relatively high temperature resistance and dielectrical properties.

The socket portion 30 can further include one or more extension pins 34. The extension pins 34 can extend longitudinally through the socket portion 30. Each socket opening 32 can be provided with a corresponding extension pin 34. As is generally known, the extension pins 34 can be in electrical contact with the socket openings 32 and can extend substantially coaxially with the socket openings 32 in an end to end relationship. Accordingly, an end of the extension pin 34 can be attached to an end of the socket opening 32, such that the extension pin 34 is in electrical contact with the male pins from the pin-side electrical connector 16. The extension pin 34 can be attached in any number of ways, such as by soldering, or the like. The extension pin 34 can be attached to a conductor 122 at an end opposite from the socket opening 32. Accordingly, the socket opening 32 and conductor 122 can be in electrical communication through the extension pin 34. Accordingly, once the male pins are received by the socket openings 32, the male pins can be in electrical communication with the conductors 122. As such, the pin-side electrical connector 16 will be in electrical contact with the socket-side electrical connector 18.

The socket-side electrical connector 18 can further include a coupling nut 40 for attaching the socket-side electrical connector 18 to the pin-side electrical connector 16. The coupling nut 40 can substantially surround the socket portion 30 in a circumferential manner and can be attached to the socket portion 30 in any number of ways, including, but not limited to, threading engagement (as shown), snap fit means, or the like. The coupling nut 40 can include a larger cross-sectional width than a cross-sectional width of the socket portion 30, such that a space is defined between an inner surface of the coupling nut 40 and an outer surface of the socket portion 30. The coupling nut 40 can include any number of cross-sectional shapes and sizes, including, but not limited to, circular shapes, oval shapes, quadrilateral shapes, or the like, and can have various engagement/drive surfaces such as knurled surfaces, tool mating surfaces, or the like.

The coupling nut 40 can be attached to the pin-side electrical connector 16 in a number of ways, some of which may be generally known. For instance, the coupling nut 40 can function similarly or identically to a bayonet-type locking ring. In one example, the coupling nut 40 could include pins projecting from an inner circumferential surface that can mate with corresponding grooves (see grooves in pin-side electrical connector 16 in FIG. 1), slots, projections, or the like in the pin-side electrical connector 16. As such, the pin-side electrical connector 16 can be sized to fit within the space between the coupling nut 40 and socket portion 30. Of course, it is to be understood that nearly any type of attachment structure could be provided for attaching the coupling nut 40 to the pin-side electrical connector 16. For instance, in further examples, the coupling nut 40 could be attached to the pin-side electrical connector 16 by means of a threaded type connection having a hex nut, mechanical fasteners, or the like.

Referring still to FIG. 2, the socket-side electrical connector 18 can further include a backshell 50. The backshell 50 can extend substantially coaxially with the socket portion 30. The backshell 50 can be attached to an end of the socket portion 30 such that the backshell 50 and socket portion 30 can be positioned in a continuous end to end orientation. In the shown example, the backshell 50 can be threadingly attached to the socket portion 30. For instance, the backshell 50 can include a female threaded portion at one end that can engage a male threaded portion of the socket portion 30. However, the backshell 50 can be attached to the socket portion 30 in any number of ways and is not limited to the attachment means depicted in FIG. 2. Rather, the backshell 50 can be attached to the socket portion 30 by mechanical fasteners, welding, or the like. In further examples, the backshell 50 could be integrally formed with the socket portion 30, such that the backshell 50 and socket portion 30 together define a one-piece formed structure. As such, the backshell 50 shown in FIG. 2 is merely one possible example of a backshell 50, and is not intended to be a limitation on further examples.

The backshell 50 can include a backshell body 52 that extends longitudinally between a first end 53 and a second end 54. The backshell body 52 can define a backshell bore 56 that is substantially hollow and extends between the ends of the backshell body 52. The backshell bore 56 can be in communication with openings at each end of the backshell body 52, such that the backshell body 52 can receive other structures within the backshell bore 56. The backshell bore 56 can extend substantially coaxially with the socket portion 30. The backshell bore 56 is not limited to the size and shape shown in FIG. 2, and could have a larger or smaller cross-sectional width (diameter in the shown example) and could include a substantially constant cross-sectional width along the length of the backshell body 52.

The backshell body 52 can further include a seat portion 58 positioned within the backshell bore 56. The seat portion 58 can be defined by an internal wall of the backshell body 52. The seat portion 58 can extend circumferentially relative to the backshell bore 56. As such, the seat portion 58 can extend along a plane that is substantially perpendicularly to a longitudinal axis of the backshell bore 56. In one example, the seat portion 58 can extend substantially circularly around the backshell bore 56. However, it is to be understood that the backshell body 52 is not limited to the seat portion 58 shown in FIG. 2. Rather, the seat portion 58 could include any number of sizes and shapes, some of which may be different than the example seat portion 58 shown in FIG. 2. For instance, the seat portion 58 can extend around the backshell bore 56 in a non-circular manner, such that in further examples, the seat portion 58 can include oval cross-sectional shapes, quadrilateral cross-sectional shapes (square, rectangular, etc.), or the like.

The seat portion 58 can define a portion of the backshell bore 56 having a reduced cross-sectional width along the longitudinal axis of the backshell bore 56. For instance, the seat portion 58 can project radially inwardly from an internal wall of the backshell body 52 towards the backshell bore 56. As shown in the example of FIG. 2, the seat portion 58 can be positioned closer to the second end 54 than the first end 53. However, it is to be understood that the seat portion 58 can be positioned at nearly any location along the length of the backshell body 52. For instance, the seat portion 58 could be positioned closer or further from the second end 54. Similarly, the seat portion 58 could project inwardly towards the backshell bore 56 a greater or smaller distance than shown, and is not limited to the shown example. Indeed, in other examples the seat portion 58 could define a smaller cross-sectional width (diameter in the example of FIG. 2) than as shown, or even a larger cross-sectional width. As such, it is understood that the seat portion 58 is not limited to the shown example, and could include any number of sizes and shapes.

The backshell body 52 can further include an internal threaded portion 66. The internal threaded portion 66 can be positioned at the second end 54 of the backshell body 52. The internal threaded portion 66 can extend longitudinally from the second end 54. The internal threaded portion 66 can include a female threading and, as will be described in more detail below, can receive and engage with a corresponding male threading. It is to be understood that in further examples, the internal threaded portion 66 could extend longitudinally along a longer or shorter length of the backshell body 52. As such, the example shown in FIG. 2 is merely one possible example of the internal threaded portion 66, and is not intended to be limiting.

The backshell 50 can further include a shielding ferrule 70 positioned within the backshell bore 56. The shielding ferrule 70 can extend longitudinally between a first end 71 and a second end 72. The shielding ferrule 70 can include an internal ferrule bore 74 extending longitudinally between the first end 71 and second end 72. The shielding ferrule 70 can include a number of different materials, including stainless steel, brass materials, or plated brass materials. In further examples, the shielding ferrule 70 can include a tin plated brass material. It is to be understood, however, that the shielding ferrule 70 can include nearly any material that can provide a shield from electrical interference, including, but not limited to, electromagnetic interference and/or radio frequency interference. As will be detailed below, the shielding ferrule 70 can surround the conductors 122 to provide a substantially continuous 360° electromagnetic interference shield.

The shielding ferrule 70 can include a contact portion 76 positioned at the first end 71. The contact portion 76 can define a substantially planar surface extending in a direction substantially perpendicular to the longitudinal axis of the internal ferrule bore 74. The contact portion 76 can have a substantially circular shape, though other non-circular shapes are envisioned. For instance, the contact portion 76 could include an oval shape, quadrilateral shape, or the like. The contact portion 76 can include a cross-sectional width that is larger than a cross-sectional width of the seat portion 58. For instance, if the seat portion 58 and contact portion 76 are both circular in shape, the contact portion 76 can include a larger outer diameter than an inner diameter of the seat portion 58. As such, the contact portion 76 can rest against the seat portion 58 and/or contact the seat portion 58, with the seat portion 58 limiting axial movement of the shielding ferrule 70 in a direction towards the first end 53.

The shielding ferrule 70 can further include a ledge portion 78 positioned at the first end 71. The ledge portion 78 can define a maximum cross-sectional width of the contact portion 76. The ledge portion 78 can extend in a direction substantially perpendicular to the contact portion 76. As such, the ledge portion 78 can be in close proximity to the backshell bore 56, with the ledge portion 78 having a slightly smaller cross-sectional width than a cross-sectional width of the backshell bore 56. As such, the backshell bore 56 can limit radial movement of the shielding ferrule 70 with respect to the backshell body 52.

The shielding ferrule 70 can further include an outer ferrule portion 82 extending longitudinally between the first end 71 and the second end 72. The outer ferrule portion 82 can define an outer surface of the shielding ferrule 70. The outer ferrule portion 82, in one example, can be tapered, such that the outer ferrule portion 82 can have a gradually decreasing cross-sectional width in a longitudinal direction towards the second end 72 of the shielding ferrule 70 and towards the second end 54 of the backshell 50. In a further example, the outer ferrule portion 82 can include a substantially circular cross-sectional shape, such that a diameter of the outer ferrule portion 82 can gradually decrease towards the second end 72. As such, the outer ferrule portion 82 can define a substantially conically-shaped structure having a smooth and tapered outer wall.

It is to be understood that the outer ferrule portion 82 can include nearly any type of size and shape, and is not limited to the example shown herein. For instance, in one example, the outer ferrule portion 82 can include a larger cross-sectional width (i.e., larger diameter in FIG. 2) at the first end 71. In this example, the cross-sectional width of the outer ferrule portion 82 at the first end 71 could match the cross-sectional width of the ledge portion 78, such that the outer ferrule portion 82 is as wide as the ledge portion 78 at the first end 71. In other examples, the outer ferrule portion 82 could have a smaller cross-sectional width at the first end 71 than in the shown example. In further examples, the outer ferrule portion 82 is not limited to having a conically shaped structure with a circularly shaped cross-section. Rather, the outer ferrule portion 82 could include nearly any cross-sectional shape, such that the outer ferrule portion 82 could define an oval shape, quadrilateral shape, or the like. Similarly, the outer ferrule portion 82 is also not limited to having smooth, substantially linear walls, and, instead, could have non-linear walls, such as curved walls, or the like. Accordingly, it is to be understood that the outer ferrule portion 82 depicted herein is merely one possible example and is not intended to be limiting, as the outer ferrule portion 82 could include any number of sizes and shapes.

Figure 4:
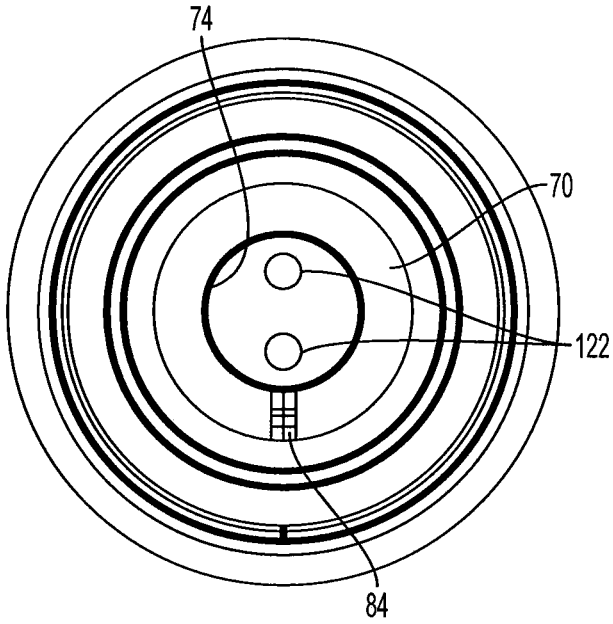
FIG. 4 is a sectional view taken along line 4-4 of FIG. 2 and shows the example electrical connector with the shielding ferrule in the uncompressed state.

The shielding ferrule 70 can further include a compression opening 84. As shown in FIG. 2 and in the sectional view of FIG. 4 taken along line 4-4 of FIG. 2, the compression opening 84 can extend longitudinally along the entire length of the shielding ferrule 70 from the first end 71 to the second end 72. The compression opening 84 can define a radial opening from the internal ferrule bore 74 and through the outer ferrule portion 82 to an exterior of the shielding ferrule 70. It is to be understood that the width of the compression opening 84 shown in FIG. 4 depicts merely one dimensional example, as the compression opening 84 could be wider or narrower. As such, when the shielding ferrule 70 is in an uncompressed state (shown in FIGS. 2 and 4), the shielding ferrule 70 can extend around the internal ferrule bore 74 less than less than 360° due to the presence of the compression opening 84. However, as will be described in more detail below, the shielding ferrule 70 can also be in a compressed state (see FIG. 3), such that the compression opening 84 is reduced in size such that the shielding ferrule 70 extends around the internal ferrule bore 74 about 360°. As such, the compression opening 84 can be smaller in width (i.e., distance between opposing sides of the outer ferrule portion 82) in a compressed state (see FIG. 3) than in an uncompressed state (see FIG. 2).

Referring still to FIG. 2, the socket-side electrical connector 18 can further include a shielding adapter 100. The shielding adapter 100 can extend longitudinally between a first end 102 and a second end 104 opposite from the first end 102. The shielding adapter 100 can include an internal adapter bore 106 extending between the first end 102 and second end 104. The internal adapter bore 106 can be substantially hollow and can extend longitudinally along the entire length of the shielding adapter 100.

The shielding adapter 100 can include an attachment portion 110 positioned at the first end 102. The attachment portion 110 can define an end of the shielding adapter 100. The attachment portion 110 can function to attach the shielding adapter 100 to the backshell 50. In one example, the attachment portion 110 can include a threaded portion 112, such as a male threaded portion. The threaded portion 112 can extend from the first end 102 and at least partially along the length of the shielding adapter 100. The threaded portion 112 can be formed at an outer circumferential surface of the shielding adapter 100. The attachment portion 110 can have a slightly smaller outer diameter than a diameter of the backshell bore 56, such that the attachment portion 110 can be received within the backshell bore 56 of the backshell 50. Once the attachment portion 110 is inserted, the threaded portion 112 of the attachment portion 110 can engage and threadingly contact the internal threaded portion 66 of the backshell 50. As such, the shielding adapter 100 can be attached to the backshell 50.

It is to be understood that the attachment portion 110 depicted in FIGS. 2 and 3 is merely one possible example of an attachment means for attaching the shielding adapter 100 to the backshell 50. In further examples, the shielding adapter 100 could include any number of structures that function to attach the shielding adapter 100 within the backshell 50. For instance, the shielding adapter 100 could include a coupling nut, bayonet ring, or the like that can holding the shielding adapter 100 in engagement with the backshell 50. Similarly, other mechanical fasteners, adhesives, or the like are envisioned for attaching the shielding adapter 100 to the backshell 50. As such, the shielding adapter 100 is not limited to including the threaded portion 112, and could instead include a number of different attachment structures.

The attachment portion 110 can further include an engagement portion 114. As will be described in more detail below, the engagement portion 114 can engage and contact the outer ferrule portion 82. The engagement portion 114 can define an inner surface of the internal adapter bore 106 at the first end 102 of the shielding adapter 100. The engagement portion 114 can define a tapered end opening of the shielding adapter 100, and can have a size and shape that substantially matches the size and shape of the outer ferrule portion 82. For instance, in the shown example, the engagement portion 114 can be tapered and can have a gradually decreasing cross-sectional width (i.e., diameter in FIGS. 2 and 3) in a direction from the first end 102 towards the second end 104. As such, the engagement portion 114 can include a slope that substantially matches a slope of the outer ferrule portion 82 such that the engagement portion 114 and outer ferrule portion 82 are substantially flush with each other when in contact. Of course, it is to be understood that the engagement portion 114 is not limited to the example shown in FIG. 2, and could include any number of sizes and shapes.

The shielding adapter 100 can further include a male threaded portion 130 positioned at the second end 104. The male threaded portion 130 can extend circumferentially around an outer surface of the shielding adapter 100. The male threaded portion 130 can function to attach the shielding adapter 100 to a structure at the second end 104. For instance, in the shown example, the male threaded portion 130 can be threadingly received by a conduit fitting 132. The conduit fitting 132 can be positioned at the second end 104 of the shielding adapter 100 and can extend away from the second end 104. Of course, it is understood that the conduit fitting 132 is merely one possible example structure that can be attached to the shielding adapter 100. Indeed, any number of structures could be incorporated for attachment to the second end 104 of the shielding adapter. Similarly, the shielding adapter 100 could include other attachment structures, and is not limited to the male threaded portion 130 shown in the example. Rather, the shielding adapter 100 could include mechanical fasteners, such as coupling nuts, bayonet rings, or the like, or could be provided with adhesives that can function to attach the second end 104 of the shielding adapter 100 to the conduit fitting 132 or other devices.

Referring still to FIG. 2, the shielding adapter 100 can further include a cable 120. The cable 120 can extend longitudinally through the shielding adapter 100 from the second end 104 to the first end 102. The cable 120 can extend through the internal adapter bore 106 of the shielding adapter 100 and can exit the shielding adapter 100 at the first end 102. The cable 120 can include a number of constructions, some of which may be generally known. In one example, the cable 120 can include one or more conductors 122. The conductors 122 can extend longitudinally along the length of the cable 120. Each of the conductors 122 can be electrically connected, such as by wire soldering, to the extension pin 34. As such, the conductors 122 can be in electrical communication with the electrical device 12 through the pin-side conduit 14.

The cable 120 can further include a shield 124, such as a braided shield, that circumferentially surrounds the conductors 122. The shield 124 can extend longitudinally with the conductors 122 through the shielding adapter 100. The shield 124 can include a number of different materials that provide a shielding and/or protecting function to the conductors 122. For instance, the shield 124 can reduce the effects of electromagnetic radiation that act on the conductors 122. The shield 124 can include braided strands of a metal-like material, such as copper or another conducting material. In some examples, the shield 124 can be grounded, such that the shield 124 can act as a shield from electromagnetic interference on the conductors 122.

The cable 120 can further include a jacket layer 126 that circumferentially surrounds the shield 124. The jacket layer 126 is shown only in phantom in FIGS. 2 and 3 for illustrative purposes, but it is to be appreciated that the jacket layer 126 can circumferentially surround the shield 124. The jacket layer 126 can be attached to the shield 124 in any number of ways, such as by an adhesive material layer, binder tape, or the like. The jacket layer 126 can extend longitudinally with the conductors 122 and shield 124 through the shielding adapter 100. In one example, the jacket layer 126 can terminate at a location within the shielding adapter 100, such that the jacket layer 126 may not extend through the first end 102 of the shielding adapter 100. The jacket layer 126 can include a number of materials, including heat resistant materials. In one example, the jacket layer 126 can include a chlorosulfonated polyethylene (CSPE) material.

The operation of the electrical connector assembly 10 can now be described. Referring first to FIG. 2, the cable 120 can initially extend longitudinally through the backshell bore 56, through the internal ferrule bore 74, and through the internal adapter bore 106. The shielding adapter 100 can then be attached to the backshell 50. Specifically, the threaded portion 112 at the attachment portion 110 of the shielding adapter 100 can be brought into engagement with the internal threaded portion 66 of the backshell body 52. The shielding adapter 100 can be rotated, such that the attachment portion 110 can extend into the backshell bore 56. As the attachment portion 110 of the shielding adapter 100 extends further into the backshell bore 56, the attachment portion 110 can engage the shielding ferrule 70.

As the attachment portion 110 moves further longitudinally into the backshell bore 56, the engagement portion 114 can contact the shielding ferrule 70. The engagement portion 114 can have a tapered shape (i.e., gradually decreasing in cross-sectional width in a longitudinal direction towards the second end 104) that can substantially match the shape of the outer ferrule portion 82 of the shielding ferrule 70. Due to the contact portion 76 of the shielding ferrule 70 contacting the seat portion 58, the shielding ferrule 70 is limited from moving axially in a direction towards the first end 53. As such, further axial movement by the engagement portion 114 can cause the outer ferrule portion 82 to radially compress. As the shielding ferrule 70 compresses, the outer ferrule portion 82 can fill in the compression opening 84. The compression opening 84 can gradually become smaller, until opposing ends of the outer ferrule portion 82 contact each other, whereupon the compression opening 84 is substantially closed (shown in FIG. 3).

In the compressed state, the shielding ferrule 70 can substantially surround the cable 120 and extend substantially 360° circumferentially around the cable 120. Accordingly, due at least in part to the material that forms the shielding ferrule 70, the shielding ferrule 70 can form a substantially continuous 360° electromagnetic interference shield around the cable 120. It is to be appreciated that by extending substantially 360° circumferentially around the cable 120, the shielding ferrule 70 can extend slightly less than 360° around the cable 120, and is not limited to exactly 360°. As such, the electromagnetic interference shield can limit the effects of electromagnetic interference, including radio frequency interference, on the cable 120 and upstream from the shielding ferrule 70 towards the electrical device 12.

The invention has been described with reference to the example embodiments described above. Modifications and alterations will occur to others upon a reading and understanding of this specification. Example embodiments incorporating one or more aspects of the invention are intended to include all such modifications and alterations insofar as they come within the scope of the appended claims.

What is claimed is:

1. An electrical connector assembly for providing an electromagnetic interference shield comprising:

a backshell having a backshell bore extending longitudinally within the backshell;

a shielding ferrule positioned within the backshell bore and configured to provide an electromagnetic interference shield, the shielding ferrule including an outer ferrule portion arranged around an internal ferrule bore; and a shielding adapter received within the backshell bore of the backshell, the shielding adapter including a cable extending longitudinally through the shielding adapter and the internal ferrule bore, the shielding adapter engaging the outer ferrule portion of the shielding ferrule such that axial movement of the shielding adapter towards the shielding ferrule is configured to radially compress the shielding ferrule onto the cable, wherein the shielding ferrule is configured to provide a substantially 360° electromagnetic interference shield around the cable.

2. The electrical connector assembly of claim 1, wherein the shielding ferrule further includes a compression opening extending radially outwardly from the internal ferrule bore and through the outer ferrule portion, the compression opening extending longitudinally along an entire length of the shielding ferrule.

3. The electrical connector assembly of claim 2, wherein in an uncompressed state, the shielding ferrule extends less than 360° circumferentially around the internal ferrule bore.

4. The electrical connector assembly of claim 3, wherein the shielding ferrule is configured to radially compress such that in a compressed state, the shielding ferrule extends substantially 360° circumferentially around the internal ferrule bore.

5. The electrical connector assembly of claim 4, wherein the compression opening has a smaller width in the compressed state than in the uncompressed state.

6. The electrical connector assembly of claim 2, wherein the outer ferrule portion includes a tapered shape and has a decreasing diameter along a longitudinal direction towards the shielding adapter.

7. The electrical connector assembly of claim 6, wherein the shielding adapter includes an engagement portion sized to receive the outer ferrule portion.

8. The electrical connector assembly of claim 7, wherein axial movement of the shielding adapter in a direction towards the outer ferrule portion as the engagement portion contacts the outer ferrule portion is configured to radially compress the shielding ferrule onto the cable.

9. The electrical connector assembly of claim 3, wherein the shielding ferrule includes a ledge portion positioned at an end of the shielding ferrule, the ledge portion extending radially outwardly from the outer ferrule portion and having a diameter that is larger than a maximum diameter of the outer ferrule portion.

10. The electrical connector assembly of claim 9, wherein the backshell further includes a seat portion extending radially inward towards the backshell bore, the seat portion having a diameter that is smaller than the diameter of the ledge portion such that seat portion is configured to limit axial movement of the shielding ferrule when the ledge portion contacts the seat portion.

11. The electrical connector assembly of claim 1, wherein the shielding ferrule includes a tin plated brass material.

12. An electrical connector assembly for providing an electromagnetic interference shield comprising:

a backshell having a backshell bore extending longitudinally within the backshell, the backshell including a seat portion extending radially inward towards the backshell bore;

a shielding ferrule positioned within the backshell bore and configured to provide an electromagnetic interference shield, the shielding ferrule limited from moving axially with respect to the backshell by the seat portion; and a cable including at least one conductor, the cable extending through an internal ferrule bore of the shielding ferrule and into the backshell bore, wherein the shielding ferrule is configured to radially compress onto the cable such that the shielding ferrule is configured to provide a substantially 360° electromagnetic interference shield around the cable to the at least one conductor.

13. The electrical connector assembly of claim 12, further including a shielding adapter received within the backshell bore, the shielding adapter including an attachment portion extending substantially coaxially with the cable, the attachment portion having a male threaded portion.

14. The electrical connector assembly of claim 13, wherein the backshell includes a female threaded portion disposed at an end.

15. The electrical connector assembly of claim 14, wherein the attachment portion of the shielding adapter is inserted into the backshell bore such that the male threaded portion engages the female threaded portion.

16. An electrical connector assembly for providing an electromagnetic interference shield comprising:

a backshell having a backshell bore extending longitudinally within the backshell, the backshell including a seat portion extending radially inward towards the backshell bore;

a shielding ferrule positioned within the backshell bore of the backshell, the shielding ferrule configured to engage the seat portion such that the seat portion limits axial movement of the shielding ferrule with respect to the backshell, the shielding ferrule further including a tapered outer ferrule portion having a decreasing cross-sectional width along a direction extending longitudinally away from the seat portion; and a shielding adapter received within the backshell bore, the shielding adapter including a cable extending longitudinally through the shielding adapter, the shielding adapter engaging the tapered outer ferrule portion of the shielding ferrule, wherein axial movement of the shielding adapter towards the shielding ferrule is configured to radially compress the shielding ferrule onto the cable.

17. The electrical connector assembly of claim 16, wherein the shielding ferrule includes a tin plated brass material and extends substantially 360° circumferentially around the cable.

18. The electrical connector assembly of claim 16, wherein the cable includes at least one conductor surrounded by a braided shield.

19. The electrical connector assembly of claim 18, wherein the shielding ferrule contacts the braided shield and is configured to provide an electromagnetic interference shield extending substantially 360° circumferentially around the cable.

* * * * *